US006003844A

United States Patent [19]

Konagai et al.

[11] Patent Number: 6,003,844

[45] Date of Patent: Dec. 21, 1999

[54] DUAL CARBURETOR

[75] Inventors: Gensaku Konagai; Tokio Tanimura, both of Atsugi, Japan

[73] Assignee: Nippon Carburetor Co., LTD, Kanagawa, Japan

[21] Appl. No.: 08/994,027

[22] Filed: Dec. 18, 1997

[30] Foreign Application Priority Data

Dec. 20, 1996 [JP] Japan ..... 8-354852

[51] Int. Cl.[6] ..... F02M 19/10

[52] U.S. Cl. ..... 261/23.2

[58] Field of Search ..... 261/23.2, 23.3, 261/23.4, 41.2, 41.3

[56] References Cited

U.S. PATENT DOCUMENTS

| | | | |
|---|---|---|---|
| 1,014,551 | 1/1912 | Winton | 261/23.2 X |
| 1,186,797 | 6/1916 | Kingston | 261/23.2 X |
| 3,188,060 | 6/1965 | Kalert, Jr. | 261/23.2 |
| 3,245,667 | 4/1966 | Kittler et al. | 261/23.2 X |
| 3,317,196 | 5/1967 | Smith | 261/23.2 |
| 4,380,516 | 4/1983 | Matsuzaka | 261/23.2 |
| 4,430,275 | 2/1984 | Horton | 261/23.2 X |

*Primary Examiner*—Richard L. Chiesa
*Attorney, Agent, or Firm*—Baker & Botts, L.L.P.

[57] ABSTRACT

A dual carburetor, designed to simplify passage constructions of the main fuel system and the low-speed fuel system and to improve the productivity, production cost, quick response and reliability in fuel supply, includes main fuel passages (14) and low-speed fuel passages (19) extending vertically from a central portion of a fuel chamber (6) to the height of and between two air suction passages (2). Main nozzles (18) are connected to upper end portions of the main fuel passages (14), and the low-speed fuel passages (19) are bent at its upper end in horizontal directions to reach low-speed ports. Air bleed passages (24, 26) for respective fuel passages (14, 19) are formed to extend from near inlets of air suction passages (2) in horizontal directions to communicate with the fuel passages (14, 19), respectively.

4 Claims, 4 Drawing Sheets

DUAL CARBURETOR

BACKGROUND OF THE INVENTION

1. Field of the Invention

This invention relates to a dual carburetor used for fuel supply or a two-cylinder engine and, more particularly, to a dual carburetor with compact-structured main fuel passages and low-speed fuel passages.

2. Description of the Related Art

Duel carburetors, in particular, duel side-flow carburetors with horizontally extending two parallel intake passages, are widely used in two-cylinder outboard engines or stationary engines because they need no particular consideration on appropriate distribution of a fuel upon being mounted in a two-cylinder engine.

In dual carburetors, in general, independent main fuel passages and low-speed fuel passages are provided for respective air suction passages, as shown in U.S. Pat. No. 3,188,060, for example.

FIG. 7 is a diagram illustrating, in particular, the construction of passages in a conventional dual carburetor of this type. Two air suction passages 53, 53 extend in parallel in horizontal directions above a float-type fuel chamber 51. Choke valves 54 are attached to a single choke valve rod 55 extending across two air suction passages 53, 53. Similarly, throttle valves 56 are attached to a single throttle valve rod 57 extending across two air passages 53, 53.

Main fuel passages 59, 59 for two air suction passages 53, 53 are located at opposite sides of a float 52 in the fuel chamber 51. These main fuel passages 59 are branched from a delivery passage 58 opening at the bottom of the fuel chamber 51, then extend substantially upwardly along opposite sides of the float 52. Each of the main fuel passages, 59, has a main jet 60, emulsion tube 61, and main nozzle 62. A main air bleed tube 63 for each main fuel passage 59 extends horizontally from near its inlet along the bottom, and then slopes down to the emulsion tube 61. A main air bleed jet 64 is provided at the inlet of each main air bleed passage 63.

Similarly, two low-speed fuel passages 65, 65 are provided for two air suction passages 53, 53. Each low-speed fuel passage 65 is branched from each main fuel passage 59 between the main jet 60 and the emulsion tube 61, first extends vertically outside each air suction passage 53 and then runs horizontally to near the throttle valve 56. Each low-speed fuel conduit 65 has a slow jet 66 and an emulsion tube 67 in its vertical portion, and a slow port 68, as a low-speed port, and an idle port 69 at the terminal end of its horizontal portion. A low-speed air bleed passage 71 is provided for each low-speed fuel passage 65. Each low-speed air bleed passage 71 extends from near the inlet of the air suction passage 53 first horizontally above it and then vertically outside it to the emulsion tube 67. A low-speed air bleed jet 72 is provided at the inlet of each low-speed air bleed passage 71.

As to the construction of passages for the main fuel systems including the main fuel passages 59 and the main air bleed passages 63 and the construction of passages for the low-speed fuel systems including the low-speed passages 65 and the low-speed air bleed passages 71, the main fuel passages 59 have a very simple construction, namely, they extends substantially straight from the bottom of the fuel chamber 51 along one side thereof.

However, the main air bleed passages 63, low-speed fuel passages 65 and low-speed air bleed passages 71 have portions extending horizontally, diagonally and vertically.

Especially the low-speed fuel passages 65 and the low-speed air bleed passages 71 turn several times and form complex shapes as a whole. It is very difficult or, at least, troublesome to make these complex forms by drilling for respective turn or curve portions and to reliably seal a number of end apertures used for inserting a drill. These factors have heretofore disturbed improvements in production efficiency and production cost.

OBJECTS AND SUMMARY OF THE INVENTION

It is therefore an object of the invention to overcome the problems involved in the prior art dual carburetors, namely, the complexity in its passage construction which disturbs improvements in production efficiency and reduction of the production cost, and to provide a dual carburetor having a simple passage construction of main and low-speed fuel systems and therefore contributing to improvements in production efficiency and production cost.

A further object of the invention is to provide a dual carburetor that can supply an appropriate amount of fuel whenever required for an engine.

A still further object of the invention is to provide a dual carburetor that can reliably supply an appropriate amount of fuel regardless of changes in its posture.

According to the invention, there is provided a dual carburetor including a fuel chamber and two air suction passages extending horizontally in parallel with each other above the fuel chamber, and including two main fuel systems and two low-speed fuel systems provided independently for individual air suction passages, comprising;

- two main fuel passages for two air suction passages extending in parallel with each other in a vertical direction from a central portion of the fuel chamber to a position between two air suction passages, and the main fuel passages having main nozzles at upper ends thereof to open into the air suction passages;
- main air bleed passages for two main fuel passages extending from near inlets of the air suction passages in a horizontal direction and connected to the main fuel passages;
- two low-speed fuel passages for two air suction passages including vertical portions vertically extending in parallel with each other from a central portion of the fuel chamber to a portion between two air suction passages, and horizontal portions extending horizontally from upper ends of the vertical portions toward outlets of the air suction passages and terminating at low-speed ports; and
- low-speed air bleed passages for two low-speed fuel passages extending in a vertical direction from near the inlets of the air suction passages and connected to the vertical portions.

Since the main fuel passages, main air bleed passages, low-speed fuel passages and low-speed air bleed passages have simple constructions with no, or much less, turning portions, passages need less drill-working steps, and the production efficiency and the production cost are therefore improved.

Moreover, since both the main fuel passages and the low-speed fuel passages are simple in construction, the fuel is supplied in quick response to the request from the engine, and the feature of introducing the fuel from a central portion of the fuel chamber results in reliable supply of the fuel even upon changes in posture of the dual carburetor.

Selective portions of the main fuel passages and the low-speed fuel passages extending inside the fuel chamber are preferably made in a block member separate from the main body of the carburetor. Alternatively, parts or all of the main air bleed passages and the low-speed air bleed passages, and the main nozzles, are preferably made in a block member separate from the main body of the carburetor. These constructions contribute to a further improvement of the productivity.

DETAILED DESCRIPTION OF THE PREFERRED EMBODIMENTS

Figure 1:
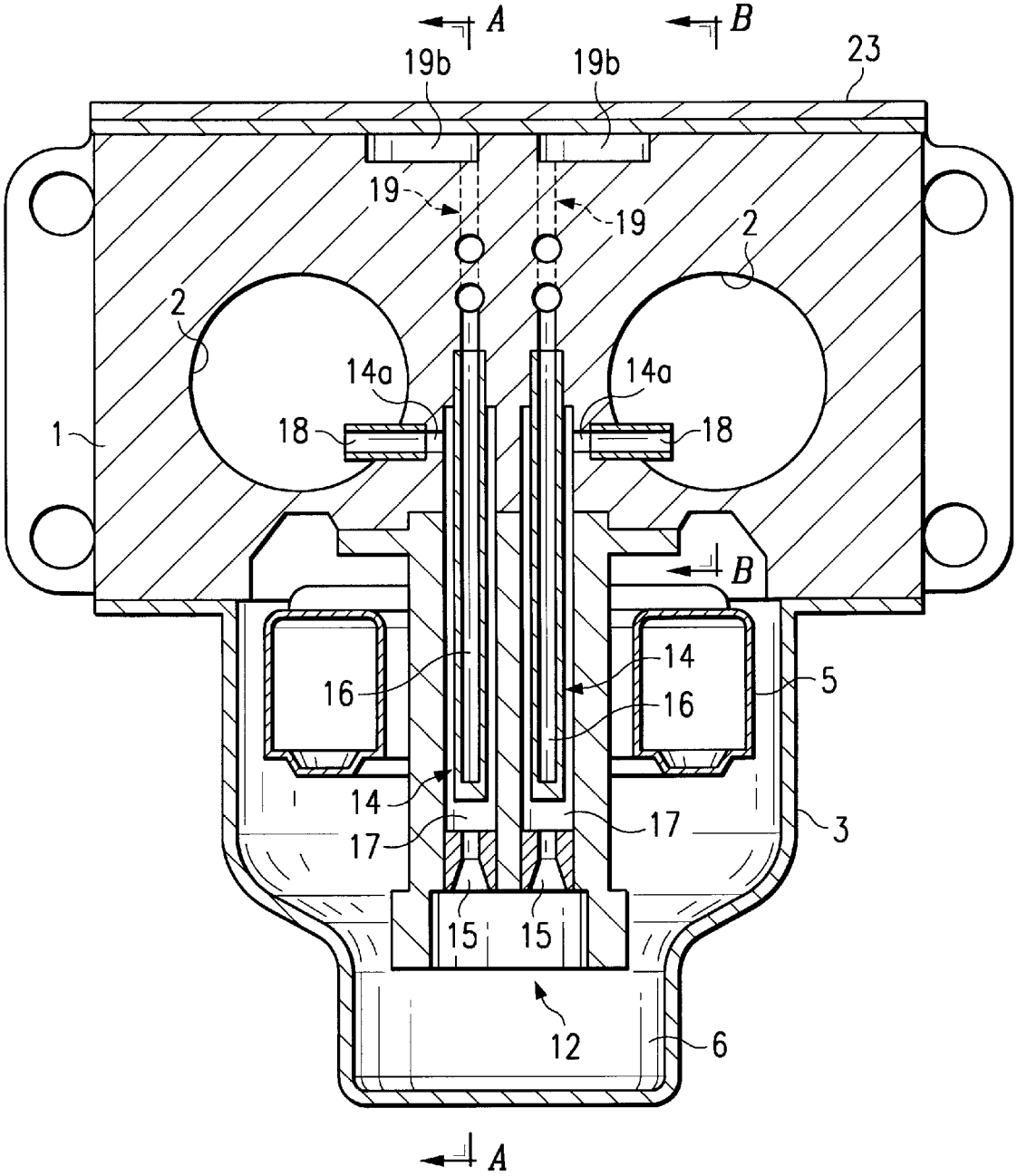
FIG. 1 is a longitudinal cross-sectional view of a dual carburetor according to an embodiment of the invention.
Figure 2:
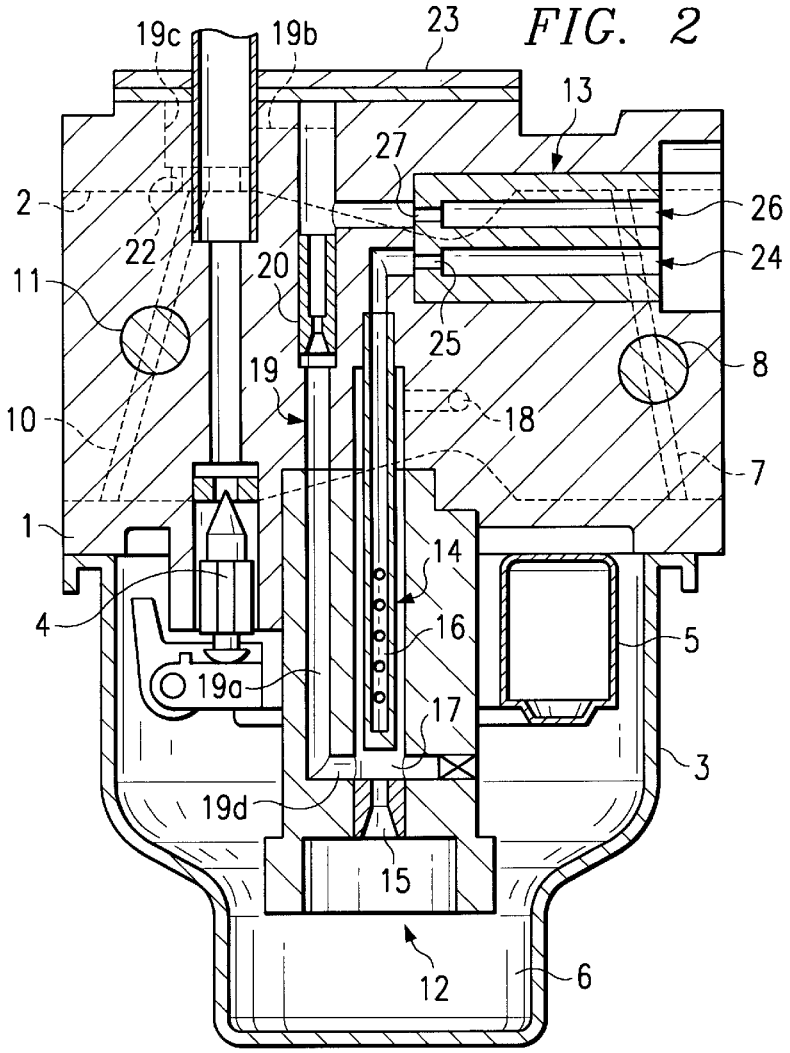
FIG. 2 is a cross-sectional view of the same dual carburetor, taken along the A—A line of FIG. 1.
Figure 3:
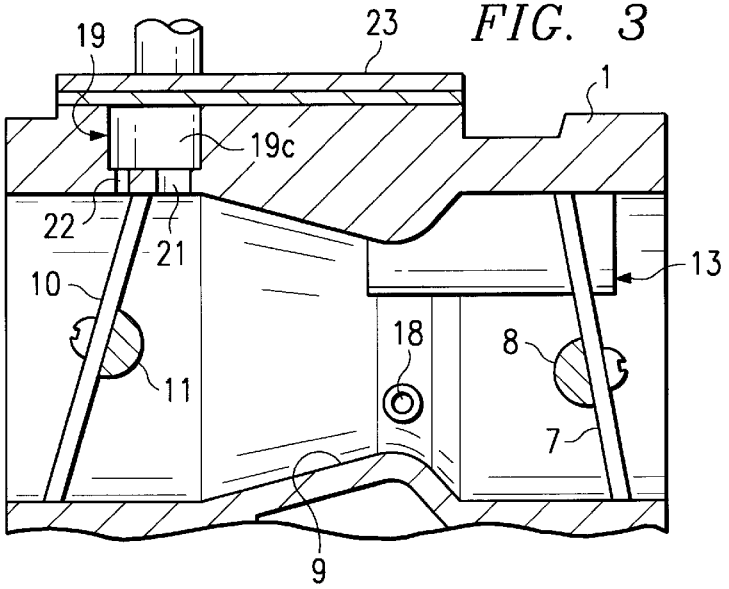
FIG. 3 is a fragmentary cross-sectional view of the same dual carburetor, taken along the B—B line of FIG. 1.
Figure 4:
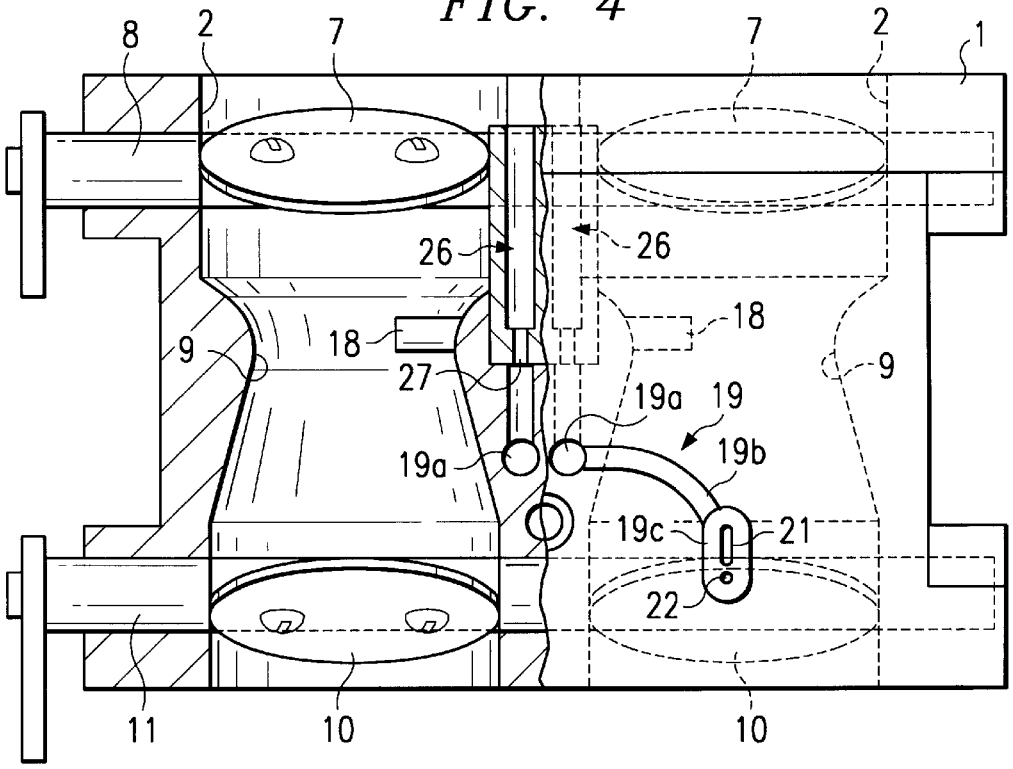
FIG. 4 is a plan view of the same dual carburetor shown in FIG. 1 from which part of overlying elements is cutout to give a better sight into the interior structure.

Some embodiments of the invention are described below with reference to the drawings. FIGS. 1 through 4 show a dual carburetor embodying the invention, in which a cup-shaped fuel bowl 3 is mounted under the carburetor main body 1 having two air suction passages 2, 2 extending in parallel in a horizontal direction. The interior of the fuel bowl 3 forms a fuel chamber 6 containing a float 5 for opening and shutting a fuel valve 4.

Each of these two air suction passages 2, 2 has a choke valve 7, Venturi 9 and throttle valve 10 from its inlet toward the outlet. Two choke valves 7 are attached to a single choke valve rod 8 extending across and supported by the carburetor main body 1 to open or close the air suction passages 2, 2 simultaneously. Similarly, two throttle valves 10 are attached to a single throttle valve rod 11 extending across and supported by the carburetor main body to open or close the air passages 2, 2 simultaneously.

Contained in a central portion of the fuel chamber 6 is a polygonal column-shaped block member 12. The polygonal column-shaped block member 12 has an upper end edge in contact with the bottom surface of the carburetor main body 1 and fastened by bolts and gaskets (not shown) to support the block member 12 in a pending fashion. The lower end of the block member 12 terminates slightly above the bottom of the fuel chamber 6. Another rectangular column-shaped block member 13 is plugged into a cavity in the carburetor main body 1 formed in an upper hair portion thereof between two air passages 2, 2. The block member 13, when plugged in position, extends from near their inlets to near the narrowest portions of the Venturi 9, 9, and are detachably, air-tightly fixed there by bolts and gaskets (not shown).

Two main fuel passages 14, 14 for supplying main fuel to two air suction passages 2, 2 extend vertically straight in parallel with each other from the lower end of the block member 12 to a position between the air suction passages 2, 2. Main jets 15, 15 are attached to lower ends of the main fuel passages 14, 14, and emulsion tubes 16, 16 are inserted into the main fuel passages 14, 14 and fixed at their upper ends. Thus, the parts of the main fuel passages 14, 14 above the main jets 15, 15 form emulsion chambers 17, 17. Main nozzles 18, 18 are fixed to the carburetor main body 1 near upper ends of the emulsion chambers 17, 17 to communicate therewith via short horizontal paths 14*a*, 14*a* extending in the horizontal direction from the main fuel passages 14, 14.

Low-speed fuel passages 19, 19 for two air suction passages 2, 2 branch from bottoms of the emulsion chambers 17, 17 in two main fuel passages 14, 14. Each of these two low-speed fuel passages 19, 19 includes a vertical portion 19*a* which extends vertically straight in parallel with the main fuel passages 14, 14 from near the lower end of the block member 12 to the upper end of the carburetor main body 1, and a horizontal portion 19*b* in form of a groove extending along the upper surface of the carburetor main body 1 and slightly curving toward the outlet of the air suction passage 2 up to a port chamber 19*c*. A slow port 21, as a low-speed port, and an idling port 22 open into each part chamber 19*c*.

A low-speed jet 20 is provided in a position within the carburetor main body 1 of the vertical portion 19*a* of each low-speed fuel passage 19. The vertical portions 19, 19*b* and the port chambers 19*c*, 19*c* of low-speed fuel passages 19, 19 are covered by a cover member 23 capping the upper surface of the carburetor main body 1, and are air-tightly sealed by a gasket.

The block member 13 fixed between two air suction passages 2, 2 defines two pairs of main air bleed passages 24 and low-speed air bleed passages 26 extending in parallel from the inlet end surface of block member 13 to a position near the Venturi 9, 9 of the carburetor main body 1 toward central axes of the air suction passages 2, 2. These main air bleed passages 24, 24 and low-speed air bleed passages 26, 26 communicate with the main fuel passages 14, 14 and low-speed fuel passage5 19, 19, respectively. More specifically, main air bleed passages 24, 24 merge the main fuel passages 14, 14 at their upper ends, and the low-speed air bleed passages 26, 26 merge the low-speed fuel passage 19, 19 downstream the low-speed jets 20, 20 in the vertical portions 19*a*, 19*a*. Within the block member 13, the main air bleed passages 24, 24 include main air bleed jets 25, 25, and the low-speed air bleed passages 26, 26 include low-speed air bleed jets 27, 27.

In the embodiment having the above-explained construction, each main fuel passage 14 once turns right angles from the vertically extending portion toward the main nozzle 18, and the low-speed fuel passage 19 turns twice by 90 degrees between the vertical portion 19*a* thereof and a horizontally extending branch portion 19*d* terminating at the main fuel passage 14 and between the vertical portion 19*a* and the horizontal portion 19*b*. The main air bleed passages 24, 24 and the low-speed air bleed passages 26, 26 extend straight and have no turning portion.

That is, the embodiment remarkably reduces the steps for drill-working tubes, and needs plugging only at openings of the branch portions 19*d* used for inserting a drill. Therefore, the embodiment greatly improves the production efficiency and the production cost. Additionally, the very simple structure of tubes and conduits ensures quick-responsive fuel supply even upon a sudden change in engine speed.

Moreover, since the fuel to be sent to two air suction passages 2, 2 is pumped up from a central portion of the fuel chamber 6, which is least affected by changes in pressure caused by an inclination of the fuel surface upon a change in posture, the dual carburetor reliably supplies the fuel equally to two air suction passages 2, 2, and thereby ensures a good operation of the engine.

The horizontal portions 19*b*, 19*b* of the low-speed fuel passages 19, 19 may be made in form of holes by drill-working instead of being made as grooves. The main fuel passages 14, 14 and the vertical portions 19*a*, 19*a* of the low-speed fuel passages 19, 19 may be made in a column-shaped member integrally pending from the carburetor main body 1 into the fuel chamber 6. The main air bleed passages 24, 24 and the low-speed air bleed passages 26, 26 may be built in the carburetor main body 1 itself, instead of being made in the separate block member.

However, when using the block members 12, 13 separate from the carburetor main body 1 and making these air bleed passages in these block members so as to insert the block members into the carburetor main body 1 later, as explained with the embodiment, the main jets 15, main air bleed jets 25 and the low-speed bleed jets 27 can be assembled and checked for maintenance more easily. Moreover, this construction makes it easy to cope with changes in specification, and hence improves the productivity.

Figure 5:
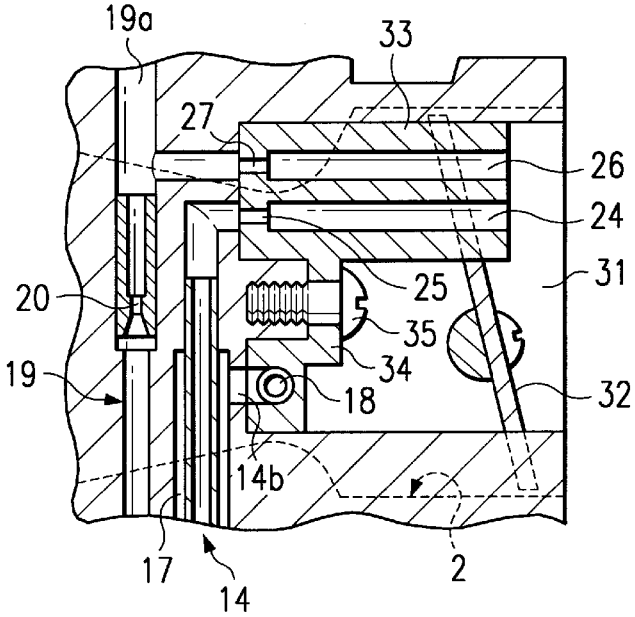
FIG. 5 is a longitudinal, fragmentary cross-sectional view of a dual carburetor according to a further embodiment of the invention.
Figure 6:
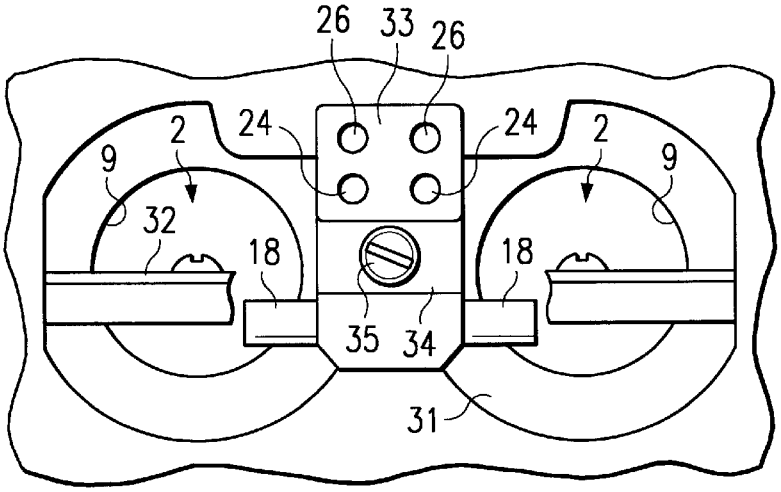
FIG. 6 is a view of the carburetor shown in FIG. 5, taken from the right side or FIG. 5.
Figure 7:
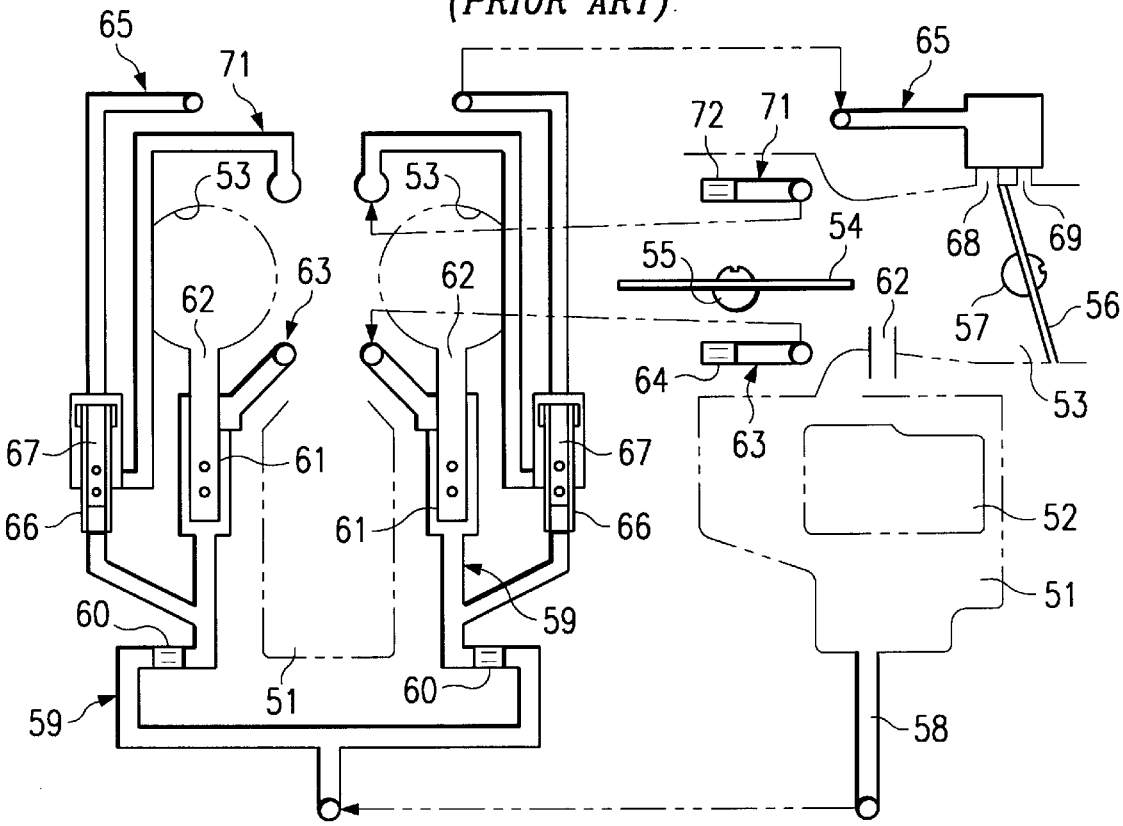
FIG. 7 (PRIOR ART)
FIG. 7 is a cross-sectional view of a prior art dual carburetor to show positional relations among elements thereof.

FIGS. 5 and 6 show another embodiment of the invention. In this embodiment, the upstream portion of the Venturi 9, 9 form a single inlet passage 31 common to two air suction passages 2, 2, and a single choke valve 32 is provided there.

A rectangular column-shaped block member 33 is inserted into the inlet passage 31 in a position between two air suction passages 2, 2. The block member 33 has a bracket 34 projecting from its deep end at right angles. The block member 33 is detachably fixed to the carburetor main body 1 near the inlet ends of the Venturi 9, 9 by screws 35 inserted into the carburetor main body 1 through the brackets.

The block member 33 defines two pairs of main air bleed passages 24 and low-speed air bleed passages 26 extending in parallel from the inlet end surface of block member 13 to the opposite end surface nearer to the Venturi 9, 9 toward central axes of the air suction passages 2, 2. These main air bleed passages 24, 24 and low-speed air bleed passages 26, 26 communicate with the main fuel passages 14, 14 and low-speed fuel passages 19, 19. More specifically, main air bleed passages 24, 24 merge the main fuel passages 14, 14 at their upper ends, and the low-speed air bleed passages 26, 26 merge the low-speed fuel passage 19, 19 downstream the low-speed jets 20, 20 in the vertical portions 19*a*, 19*a*. Within the block member 33, the main air bleed passages 24, 24 include main air bleed jets 25, 25, and the low-speed air bleed passages 26, 26 include low-speed air bleed jets 27, 27, like those in the embodiment shown in FIGS. 1 through 4.

In this embodiment, main nozzles 18, 18 for two air suction passages 2, 2 are formed in the bracket 34 of the block member 33. More specifically, the bracket 34 has portions extending in opposite directions from opposite sides thereof near its distal end, and bores running through these portions are used as main nozzles 18, 18. These main nozzles 18, 18 communicate with upper end portions of the emulsion chambers 17, 17 via short horizontal passages 14*b*, 14*b* formed in the carburetor main body 1.

This embodiment makes assemblage of the main nozzles 18, 18 vary easy, and hence improves the productivity of the dual carburetor.

As described above, according to the invention, main and low-speed fuel passages and main and low-speed air bleed passages have very simple forms and constructions. Therefore, the embodiment remarkably improves the production efficiency and the production cost by minimizing the steps for making passages, and additionally ensures reliable supply of a fuel to the engine with a good response, without a delay, maintaining substantially equal amounts of fuel supplied to two air suction passages.

What is claimed is:

1. A dual carburetor including a fuel chamber and two air suction passages extending horizontally in parallel with each other above the fuel chamber, and including two main fuel systems and two low-speed fuel systems provided independently for individual air suction passages, comprising:

two main fuel passages for said two air suction passages extending in parallel with each other in a vertical direction from a central portion of said fuel chamber to a location between said two air suction passages, and said main fuel passages having main nozzles at upper ends thereof to open into said air suction passages;

main air bleed passages for said two main fuel passages extending from near inlets of said air suction passages in a horizontal direction and connected to said main fuel passages;

two low-speed fuel passages for said two air suction passages including vertical portions vertically extending in parallel with each other from a central portion of said fuel chamber to a portion between said two air suction passages, and horizontal portions extending horizontally from upper ends of said vertical portions toward outlets of said air suction passages and terminating at low-speed ports; and low-speed air bleed passages for said two low-speed fuel passages extending in a vertical direction from near the inlets of said air suction passages and connected to said vertical portions.

2. The dual carburetor according to claim 1 wherein selective portions of said main fuel passages and said low-speed fuel passages located in said fuel chamber are defined in a single block member separate from the main body of said carburetor.

3. The dual carburetor according to claim 1 wherein at least selective portions of said main air bleed passages and said low-speed air bleed passages are formed in a single block member separate from the main body of said carburetor.

4. The dual carburetor according to claim 1 wherein at least selective portions of said main air bleed passages, said slow-speed air bleed passages, and said main nozzles are formed in a single block member separate from the main body of said carburetor.

* * * * *